US011808428B2

(12) United States Patent
Jung et al.

(10) Patent No.: US 11,808,428 B2
(45) Date of Patent: Nov. 7, 2023

(54) LAMP MODULE AND LAMP FOR VEHICLE INCLUDING THE SAME

(71) Applicant: SL Corporation, Daegu (KR)

(72) Inventors: Jin Young Jung, Gyeongsan-si (KR); Seo Young Kim, Gyeongsan-si (KR)

(73) Assignee: SL Corporation, Daegu (KR)

( * ) Notice: Subject to any disclaimer, the term of this patent is extended or adjusted under 35 U.S.C. 154(b) by 12 days.

(21) Appl. No.: 18/094,258

(22) Filed: Jan. 6, 2023

(65) Prior Publication Data

US 2023/0265984 A1 Aug. 24, 2023

(30) Foreign Application Priority Data

Feb. 21, 2022 (KR) ..... 10-2022-0022309

(51) Int. Cl.
*F21S 41/32* (2018.01)
*F21S 41/14* (2018.01)

(52) U.S. Cl.
CPC ..... *F21S 41/321* (2018.01); *F21S 41/18* (2018.01)

(58) Field of Classification Search
CPC .. F21S 43/20–27; F21S 43/235; F21S 43/241; F21S 43/26; F21S 43/40; F21S 41/24–28; F21S 41/285; F21S 41/141; F21S 41/143; F21S 41/20
See application file for complete search history.

(56) References Cited

U.S. PATENT DOCUMENTS

2017/0030543 A1* 2/2017 Gromfeld ..... F21S 41/322

FOREIGN PATENT DOCUMENTS

WO WO-2017185118 A1 * 11/2017 ..... F21S 41/143

* cited by examiner

*Primary Examiner* — Mariceli Santiago
(74) *Attorney, Agent, or Firm* — United One Law Group LLC; Kongsik Kim; Jhongwoo Peck

(57) ABSTRACT

A lamp module includes a light source unit that generates light; and a light guide unit that emits at least a portion of the light incident from the light source unit to generate a beam pattern. The light guide unit comprises a light incident portion configured to receive at least a portion of the light incident from the light source unit; a light emitting portion configured to emit at least a portion of the light incident through the light incident portion; and a transmission portion disposed between the light incident portion and the light emitting portion and configured to transmit at least a portion of the light incident through the light incident portion to the light emitting portion. The transmission portion comprises a shield portion including an edge portion formed along a rear focal plane of the light emitting portion and configured to obstruct a portion of the light.

14 Claims, 14 Drawing Sheets

| | |
|---|---|
| WITH STEPPED PORTION BEING IN ALIGNMENT WITH OPTICAL AXIS OF LIGHT EMITTING PORTION |   |
| WITH STEPPED PORTION BEING SPACED APART FROM OPTICAL AXIS OF LIGHT EMITTING PORTION |   |

LAMP MODULE AND LAMP FOR VEHICLE INCLUDING THE SAME

CROSS-REFERENCE TO RELATED APPLICATION

This application claims priority from Korean Patent Application No. 10-2022-0022309 filed on Feb. 21, 2022, which is incorporated herein by reference in its entirety.

BACKGROUND

1. Technical Field

The present disclosure relates to a lamp module and a vehicle lamp including the same. More particularly, the present disclosure relates to a lamp module capable of implementing a slim design while forming an optimal beam pattern, and a vehicle lamp including the same.

2. Description of the Related Art

Vehicles are equipped with various types of lamps for an illumination function that allows the driver to easily check an object located around the vehicle at low light conditions (e.g., night-time driving) and a signaling function to notify the driving state of the vehicle to the surrounding vehicles or pedestrians.

For example, headlamps and fog lamps mainly serve the illumination function, and daytime running lamps, position lamps, turn signal lamps, tail lamps, brake lamps, or the like mainly serve the signaling function. The respective lamps are stipulated by laws and regulations for their installation standards and measures to ensure that they fully function.

Recently, not only the functional aspect that helps safe driving by enabling securing the driver's visibility, which is the basic role of the vehicle lamps, but also the aesthetic aspect that consumers feel has a significant influence on consumers' purchase decision. Therefore, design improvements for the lamps are desired.

To this end, a means for forming an optimal beam pattern while providing the vehicle lamp with a slimmer, and thus improved, exterior design is demanded.

SUMMARY

Aspects of the present disclosure provide lamp modules each with a stepped portion, the position of which is particularly determined to form an inclined edge of the cut-off line of the lighting beam pattern at a correct position for each lamp module, thereby allowing the lamp module to be implemented in a slim design while providing an optimal beam formation. Aspects of the present disclosure also provide a vehicle lamp including one or more of such lamp modules. However, aspects of the present disclosure are not restricted to those set forth herein. The above and other aspects of the present disclosure will become more apparent to one of ordinary skill in the art to which the present disclosure pertains by referencing the detailed description of the present disclosure provided below.

According to an aspect of the present disclosure, a lamp module may include a light source unit that generates light; and a light guide unit configured to emit at least a portion of the light incident from the light source unit to generate a beam pattern. In particular, the light guide unit may include a light incident portion configured to receive at least a portion of the light incident from the light source unit; a light emitting portion configured to emit at least a portion of the light incident through the light incident portion; and a transmission portion disposed between the light incident portion and the light emitting portion and configured to transmit at least a portion of the light incident through the light incident portion to the light emitting portion. The transmission portion may include a shield portion including an edge portion formed along a rear focal plane of the light emitting portion and configured to obstruct a portion of the light that is incident through the light incident portion and directed to the light emitting portion.

The light incident portion may include a central surface; protruding surfaces formed to protrude from an outer peripheral end of the central surface toward the light source; and reflective surfaces for reflecting at least a portion of the light incident through the protruding surfaces toward the transmission portion disposed in front of the light incident portion.

The shield portion may include a first surface and a second surface formed on a lower side of the transmission portion, which are inclined in opposite directions along an optical axis direction of the light emitting portion. The first surface may include a first end and a second end, and the first end may be disposed closer to the light emitting portion and disposed above the second end. The second surface may include a first end disposed closer to the light emitting portion and a second end disposed above the first end. Accordingly, the edge portion may be formed at a junction between the first end of the first surface and the second end of the second surface.

The edge portion may include a stepped portion; a first edge that extends in a horizontal direction from a lower end of the stepped portion; and a second edge that extends in the horizontal direction from an upper end of the stepped portion. The stepped portion may be disposed spaced apart by a predetermined distance from an optical axis of the light emitting portion. The predetermined distance may be determined based on a width of the beam pattern to be formed by the lamp module. The width of the beam pattern may be determined by a curvature of the light emitting portion. By way of example, the predetermined distance may increase as the width of the beam pattern increases.

A lens unit may be further provided adjacent to the light guide unit to transmit at least a portion the light emitted from the light guide unit, and the lens unit may include a light incident surface for receiving at least a portion of the light incident from the light guide unit; and a light emitting surface configured to emit the light incident through the light incident surface. In particular, the light emitting surface may include a plurality of optical elements arranged in at least one direction. In some embodiments, the light incident surface may be convex rearwardly toward the light guide unit, and the optical elements may be planar. In some embodiments, the light incident surface may be planar, and the optical elements may be convex forwardly.

According to a related aspect of the present disclosure, a lamp for a vehicle may include a plurality of lamp modules arranged in at least one direction to generate a beam pattern. In particular, each of the plurality of lamp modules may include a light source unit that generates light; and light guide unit that emits at least a portion of the light incident from the light source unit to generate the beam pattern. Further, the light guide unit may include a light incident portion configured to receive at least a portion of the light incident from the light source unit; a light emitting portion configured to emit at least a portion of the light incident through the light incident portion; and a transmission portion disposed between the light incident portion and the light emitting portion and configured to transmit at least a portion of the light incident through the light incident portion to the light emitting portion. The transmission portion may include a shield portion including an edge portion formed along a rear focal plane of the light emitting portion and configured to obstruct a portion of the light that is incident through the light incident portion and directed to the light emitting portion.

The edge portion of each of the plurality of lamp modules may include a stepped portion; a first edge that extends in a horizontal direction from a lower end of the stepped portion; and a second edge that extends in the horizontal direction from an upper end of the stepped portion. In particular, the stepped portion of at least one of the plurality of lamp modules may be disposed spaced apart by a predetermined distance from an optical axis of the light emitting portion. The predetermined distance may differ from one of the plurality of lamp modules to another.

At least two of the plurality of lamp modules may generate beam patterns with different widths, and the predetermined distance may be varied depending on the widths of the beam patterns.

The lamp modules may be arranged gradually advancing or gradually receding from a first side to a second side in a vehicle's width direction when the lamp is mounted to the vehicle.

Each of the plurality of lamp modules may further include a lens unit that transmits at least a portion of the light emitted from the light guide unit. In particular, the lens unit may include a light incident surface for receiving at least a portion of the light incident from the light guide unit; and a light emitting surface that includes a plurality of optical elements arranged in at least one direction to emit the light incident through the light incident surface. The plurality of optical elements of each of the plurality of lamp modules may be in a terraced arrangement gradually advancing or gradually receding from a first side to a second side in a vehicle's width direction.

The lamp modules of the present disclosure and the vehicle lamp including the same as described herein may provide one or more of the following advantages. Since the lamp modules of the present disclosure have a stepped portion, an inclined edge of the cut-off line of a beam pattern may be formed at a correct position by each lamp module. The position of the stepped portion may be particularly determined based on the width of the beam pattern to be formed by each lamp module, allowing the vehicle lamp to be implemented in a slim design while providing the cut-off line in the correct position.

It should be noted that the advantages of the present disclosure are not limited to those described above, and other effects of the present disclosure will be apparent from the following description.

BRIEF DESCRIPTION OF THE DRAWINGS

The above and other aspects and features of the present disclosure will become more apparent by describing in detail exemplary embodiments thereof with reference to the attached drawings, in which.

DETAILED DESCRIPTION

Figure 1:
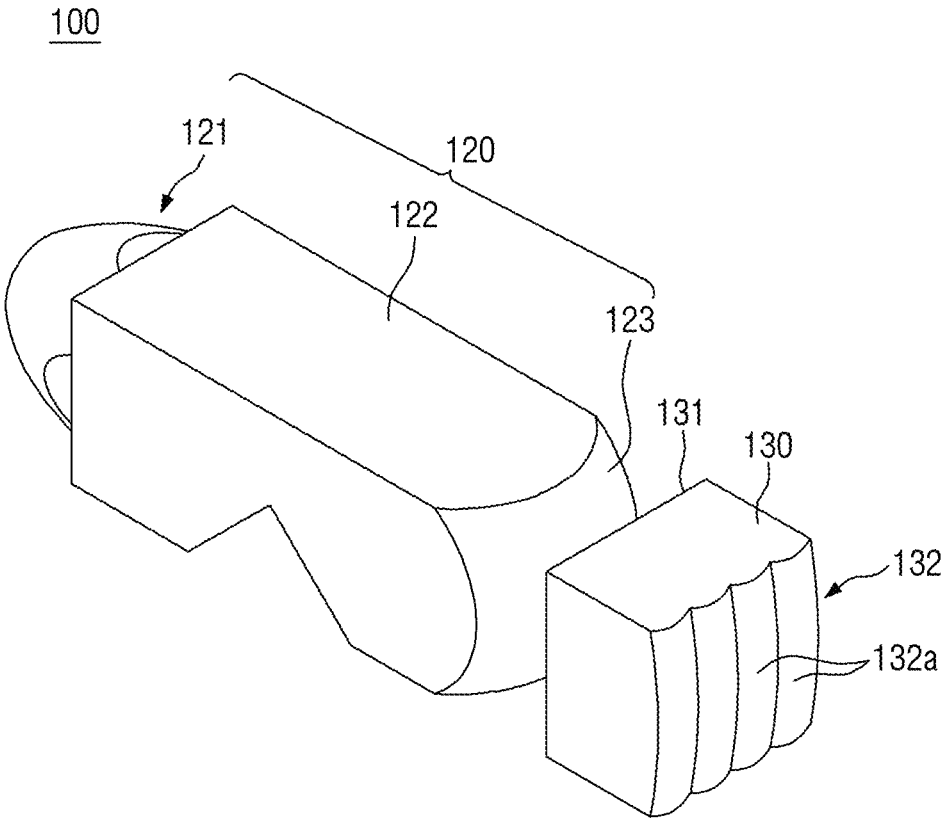
FIGS. 1 to 3 are perspective views of a lamp module according to an embodiment of the present disclosure.

Advantages and features of the present disclosure and methods of accomplishing the same may be understood more readily by reference to the following detailed description of exemplary embodiments and the accompanying drawings. The present disclosure may, however, be embodied in many different forms and should not be construed as being limited to the embodiments set forth herein. Rather, these embodiments are provided so that this disclosure will be thorough and complete and will fully convey the concept of the disclosure to those skilled in the art, and the present disclosure will only be defined by the appended claims. Throughout the specification, like reference numerals in the drawings denote like elements. In some embodiments, well-known steps, structures and techniques will not be described in detail to avoid obscuring the disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Embodiments of the disclosure are described herein with reference to plan and cross-section illustrations that are schematic illustrations of exemplary embodiments of the invention. As such, variations from the shapes of the illustrations as a result, for example, of manufacturing techniques and/or tolerances, are to be expected. Thus, embodiments of the disclosure should not be construed as limited to the particular shapes of regions illustrated herein but should be understood to include deviations in shapes that result, for example, from manufacturing. In the drawings, respective components may be enlarged or reduced in size for convenience of explanation.

Hereinafter, embodiments of the present disclosure will be described with reference to the attached drawings for a lamp module and a lamp for a vehicle including the same.

Figure 2:
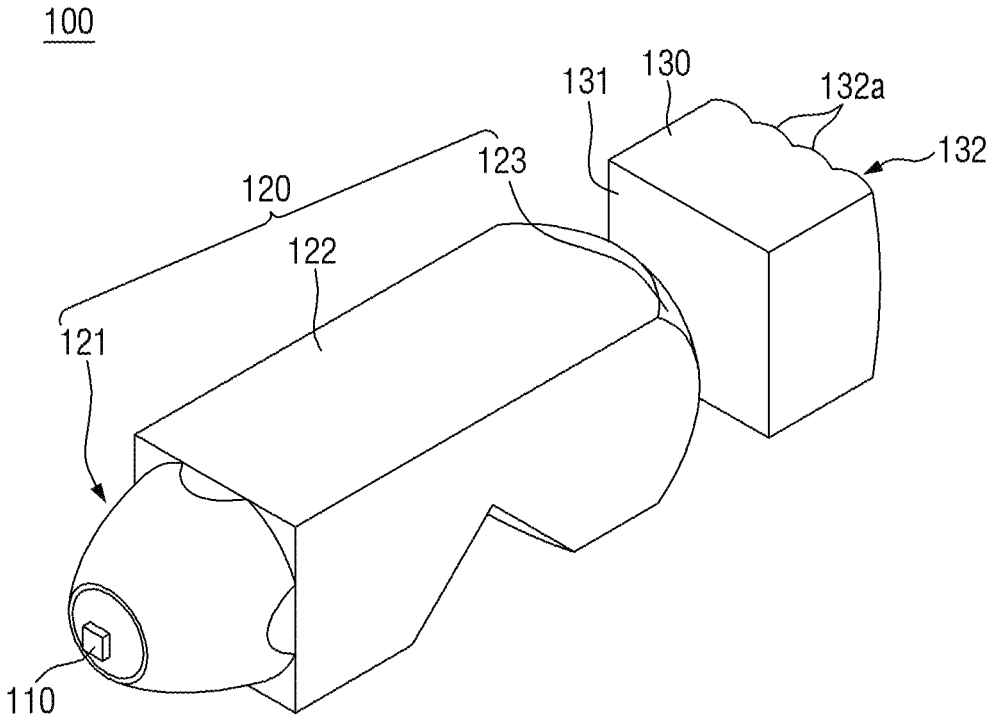
Figure 3:
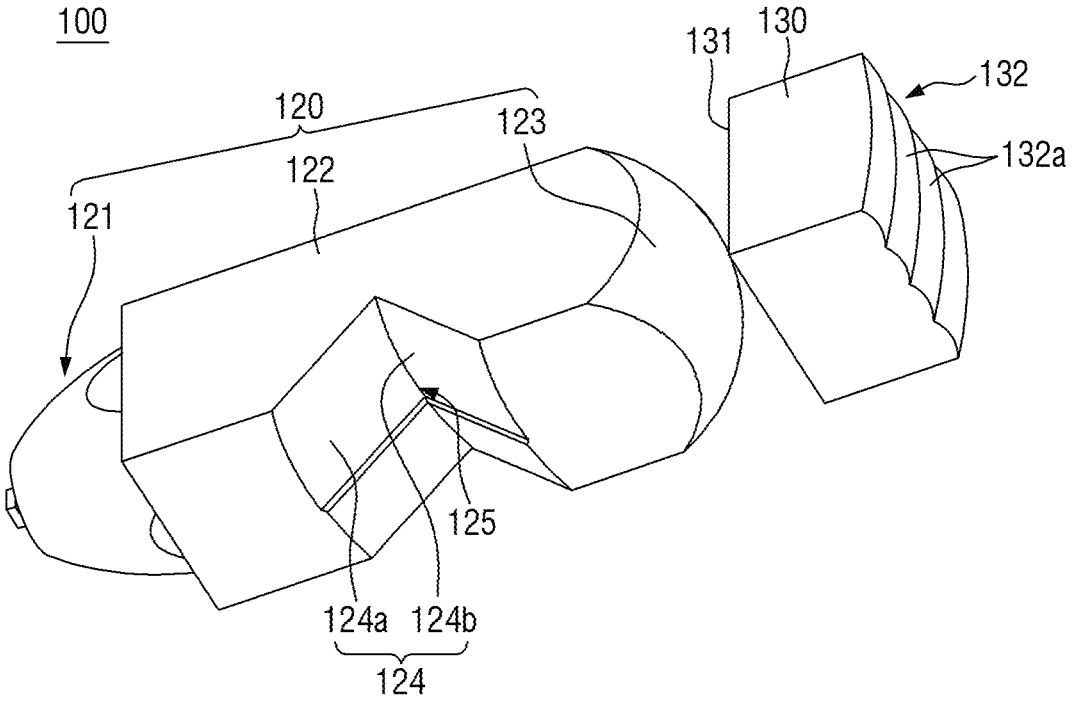
Figure 4:
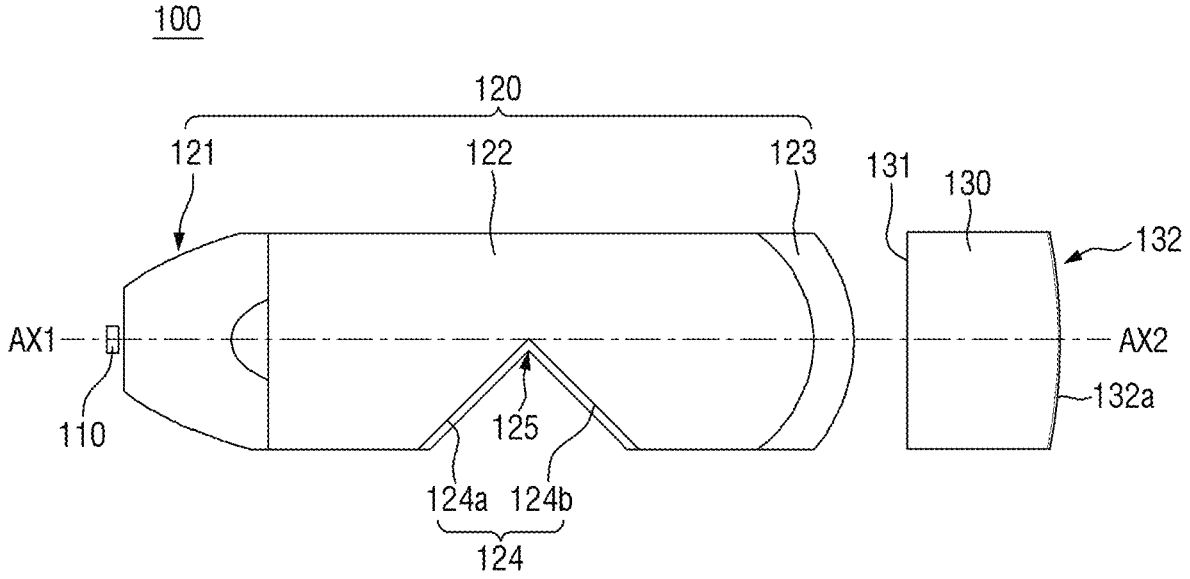
FIG. 4 is a side view of the lamp module according to an embodiment of the present disclosure.
Figure 5:
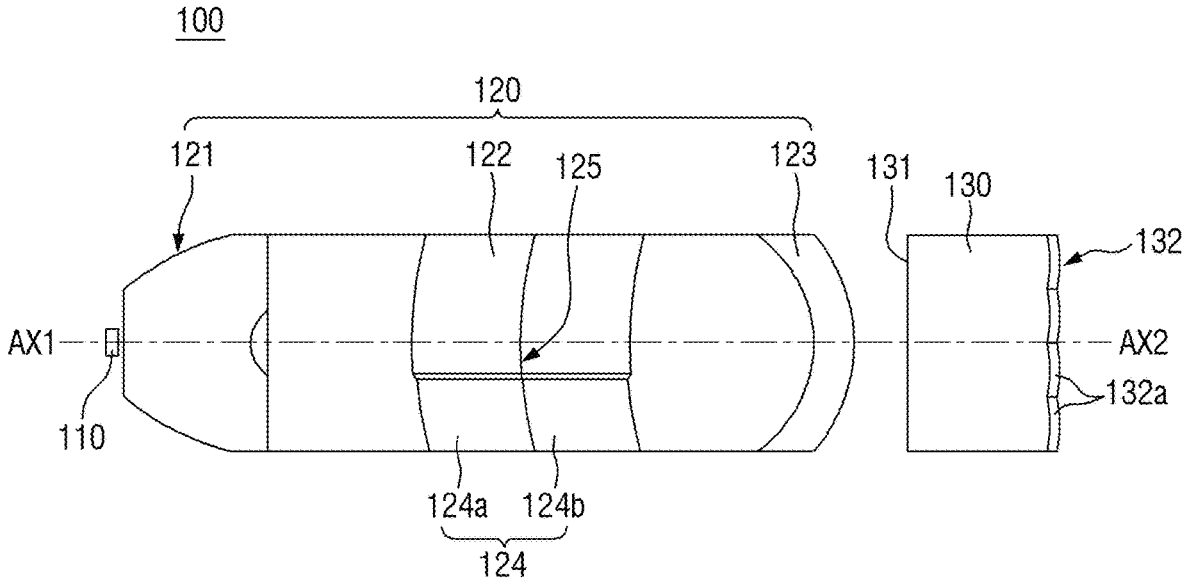
FIG. 5 is a bottom view of the lamp module according to an embodiment of the present disclosure.

FIGS. 1 to 3 are perspective views showing a lamp module 100 according to an embodiment of the present disclosure, FIG. 4 is a side view of the lamp module 100, FIG. 5 is a bottom view of the lamp module 100, and FIG.

6 is a cross-sectional view of the lamp module 100. Referring to FIGS. 1 to 6, the lamp module 100 according to an embodiment of the present disclosure may include a light source unit 110, a light guide unit 120, and a lens unit 130.

In the present embodiments of the disclosure, the lamp module 100 will be described as an example of headlamp, which is used to secure a front view by irradiating light in the driving direction of the vehicle. However, the present disclosure is not limited thereto, and the lamp module 100 of the present disclosure may be used not only for a headlamp, but also for various lamps for vehicles such as a tail lamp, a daytime running lamp, a position lamp, a turn signal lamp, a backup lamp, a brake lamp, a fog lamp, and the like.

When used for headlamps, the lamp module 100 of the present disclosure may generate a low beam pattern or a high beam pattern. The low beam pattern may be generated by irradiating light to a lower side with respect to a predetermined cut-off line to secure a wide viewing range in front of the subject vehicle while preventing glare from distracting drivers of preceding vehicles or oncoming vehicles. The high beam pattern may secure a long viewing distance in front of the subject vehicle for the driver.

Figure 7:
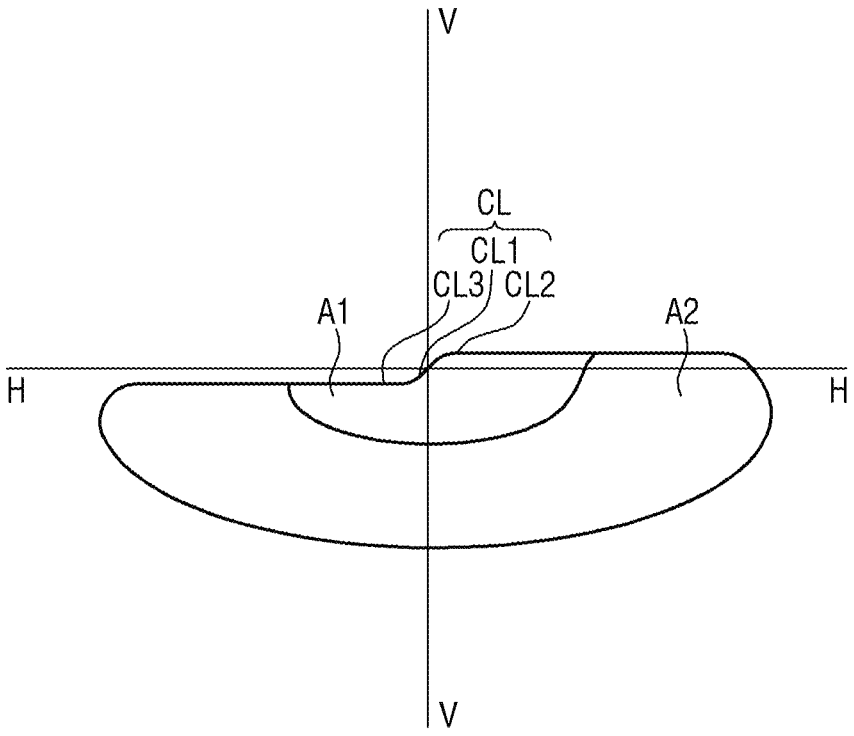
FIG. 7 is a schematic diagram of a beam pattern formed by a lamp module according to an embodiment of the present disclosure.

Hereinbelow, an embodiment as shown in FIG. 7 will be mainly described, where the lamp module 100 forms a low beam pattern in which the light is irradiated to the lower side with respect to a cut-off line CL that includes an inclined line CL1, an upper line CL2 that horizontally extends from the upper end of the inclined line CL1, and a lower line CL3 that extends horizontally from the lower end of the CL1. The low beam pattern may include a spot region A1 formed to have a relatively high brightness to ensure a sufficient viewing distance in front of the vehicle, and a spread region A2 for extending the spot region A1 in the vertical direction and/or the horizontal direction to ensure a wider field of view in front of the vehicle.

Additionally, an example of a singular lamp module 100 will be described herein. However, such configuration is only an example to help understanding of the present disclosure, and the present disclosure is not limited thereto. To satisfy light distribution characteristics, such as size, shape, brightness, and the like, of a region to which light is irradiated, a plurality of the lamp modules 100 may be arranged in at least one direction.

The light source unit 110 may include at least one light source having a light quantity and/or color suitable for the use of the lamp module 100 of the present disclosure. The present embodiment describes an illustrative case where at least one light source includes a Light Emitting Diode (LED) or such a semiconductor light emitting device, but the present disclosure is not limited thereto. The at least one light source may include not only an LED but also various types of light sources such as laser diode (LD) or bulb, and it may further include optical elements such as mirrors, prisms, reflectors, phosphors, and the like depending on the type thereof.

The light guide unit 120 may emit at least a portion of the light that is incident from the light source unit 110 to form a beam pattern suitable for the purpose of the lamp module 100 of the present disclosure. The light guide unit 120 may include a light incident portion 121, a transmission portion 122, and a light emitting portion 123. In the light guide unit 120 of the present embodiment, the light incident portion 121, the transmission portion 122, and the light emitting portion 123 may be integrally manufactured, saving the process of assembling them separately, and thereby simplifying the configuration of the light guide unit 120 and the assembly process thereof.

Figure 6:
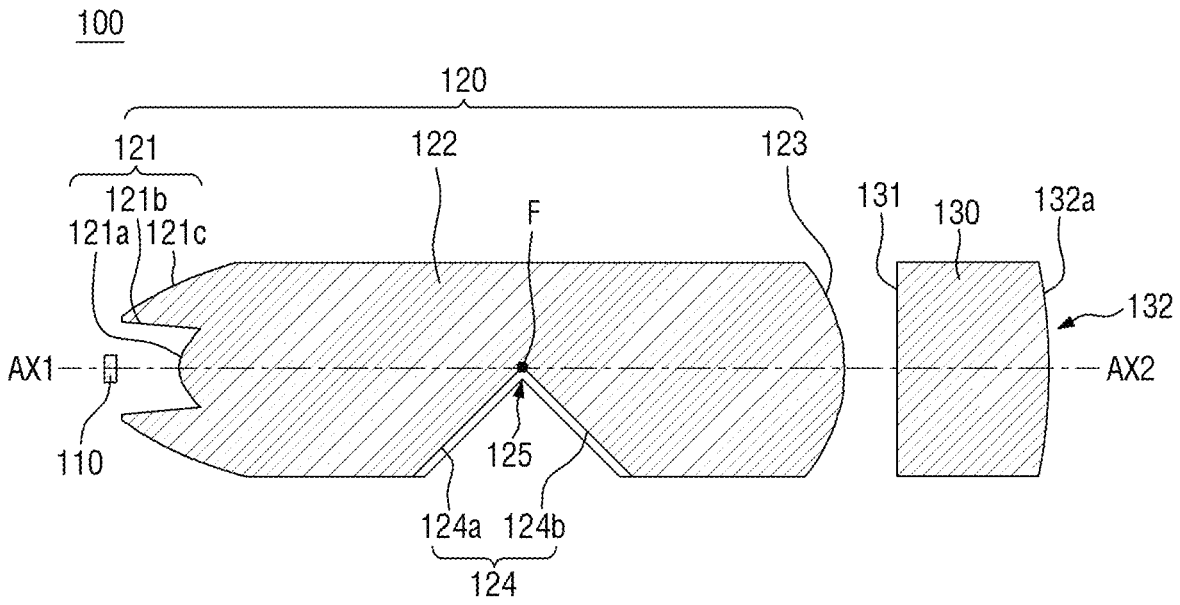
FIG. 6 is a cross-sectional view of the lamp module according to an embodiment of the present disclosure.

Referring to FIG. 6, the light incident portion 121 may include a central surface 121*a*, protruding surfaces 121*b*, and reflective surfaces 121*c*. The central surface 121*a* may be formed to be convex toward the light source unit 110 about an optical axis AX1 of the light source unit 110. The protruding surfaces 121*b* may be formed to protrude from the outer peripheral end of the central surface 121*a* toward the light source unit 110. The reflective surfaces 121*c* may reflect at least a portion of the light incident through the protruding surfaces 121*b* toward the transmission portion 122.

In such configuration, the optical axis AX1 of the light source unit 110 may be understood as an axis that passes longitudinally through the center of the light emitting area formed by at least one light source. When the light source unit 110 includes a single light source, an axis that longitudinally passes through the center of the light emitting surface of the single light source may correspond to the optical axis AX1 of the light source unit 110. When the light source unit 110 includes a plurality of light sources, an axis that longitudinally passes through the center of the entire light emitting area collectively formed by the light emitting surfaces of the respective light sources may correspond to the optical axis AX1 of the light source unit 110.

The configuration that the light incident portion 121 includes the central surface 121*a* and the protruding surfaces 121*b* may reduce the overall size of the light incident portion 121 while allowing the light generated from the light source 110 to be incident on the light incident portion 121 without loss of the light. For example, if only the central surface 121*a* is provided, it is typically necessary to make the central surface 121*a* sufficiently large such that it is commensurate to the light irradiation range of the light source unit 110 in order for the light incident portion 121 to receive the light generated from the light source unit 110 without loss of the light. Conversely, since the embodiment of the present disclosure includes the protruding surfaces 121*b* formed at the outer peripheral end of the central surface 121*a*, the central surface 121*a* may be made smaller than permitted by the light irradiation range of the light source unit 110 and may still accommodate the light generated from the light source unit 110 to be incident on the light incident portion 121 without loss of the light.

The reflective surfaces 121*c* may be formed such that they connect between the protruding ends of the protruding surfaces 121*b* and the transmission portion 122. To direct the light incident through the protruding surfaces 121*b* toward the transmission portion 122 disposed in front of the light incident portion 121, the reflective surfaces 121*c* may be formed to be widened gradually while extending along the optical axis AX1 of the light source unit 110. In other words, the reflective surfaces 121*c* may be spaced farther from the optical axis AX1 as they go farther from the light source unit 110.

The transmission portion 122 may be disposed between the light incidence portion 121 and the light emitting portion 123 and may serve to transmit at least a portion of the light incident to the light incidence portion 121 to be emitted through the light emitting portion 123.

The light emitting portion 123 may serve to emit the light transmitted by the transmission portion 122 to form a beam pattern suitable for the use of the lamp module 100 of the present disclosure. In general, the light distribution characteristic of the beam pattern to be formed by the lamp module 100 of the present disclosure may be adjusted by the light emitting portion 123. For example, adjusting the curvature of the light emitting portion 123 may in turn adjust the light distribution characteristic of the beam pattern to be formed by the lamp module 100 of the present disclosure.

Meanwhile, the transmission portion 122 may include a shield portion 124 to obstruct some of the light that is incident on the light incident portion 121 from proceeding to the light emitting portion 123. The shield portion 124 may include a first surface 124*a* and a second surface 124*b* that are formed at a lower side in the transmission portion 122 and are inclined with respect to each other in opposite directions. Hereinbelow, in an example of the present disclosure, the second surface 124*b* may be disposed closer to the light emitting portion 123 than the first surface 124*a* along an optical axis AX2 of the light emitting portion 123.

The present embodiment of the present disclosure illustrates a case in which the optical axis AX1 of the light source unit 110 coincides with the optical axis AX2 of the light emitting portion 123. However, the present disclosure is not limited thereto. Depending on the layout and design requirements, the optical axis AX1 of the light source unit 110 may be positioned to intersect with the optical axis AX2 of the light emitting portion 123.

The first surface 124*a* may have a first end that is closer to the light emitting portion 123 and a second end that is farther from the light emitting portion 123 and disposed below the first end. The second surface 124*b* may have a first end that is closer to the light emitting portion 123 and a second end that is disposed above the first end. The first end of the first surface 124*a* and the second end of the second surface 124*b* may be positioned to be in contact with each other.

Regarding the contact line between the first end of the first surface 124*a* and the second end of the second surface 124*b*, an edge portion 125 may be formed to create a cut-off line of the lighting beam pattern. The edge portion 125 may be formed along a focal plane or near the focal plane where a rear focal point F of the light emitting portion 123 is disposed, in order to obstruct the light from being irradiated to the upper side of the cut-off line, thereby generating a low beam pattern by which the light is irradiated to a lower side with respect to the cut-off line, as shown in FIG. 7.

The edge portion 125 may be formed to extend from the lateral center of the light guide unit 120 to both sides along the focal plane of the light emitting portion 123. Depending on the shape of the focal plane of the light emitting portion 123, the edge portion 125 may have a linear shape, a curved shape, or a combination thereof.

Figure 8:
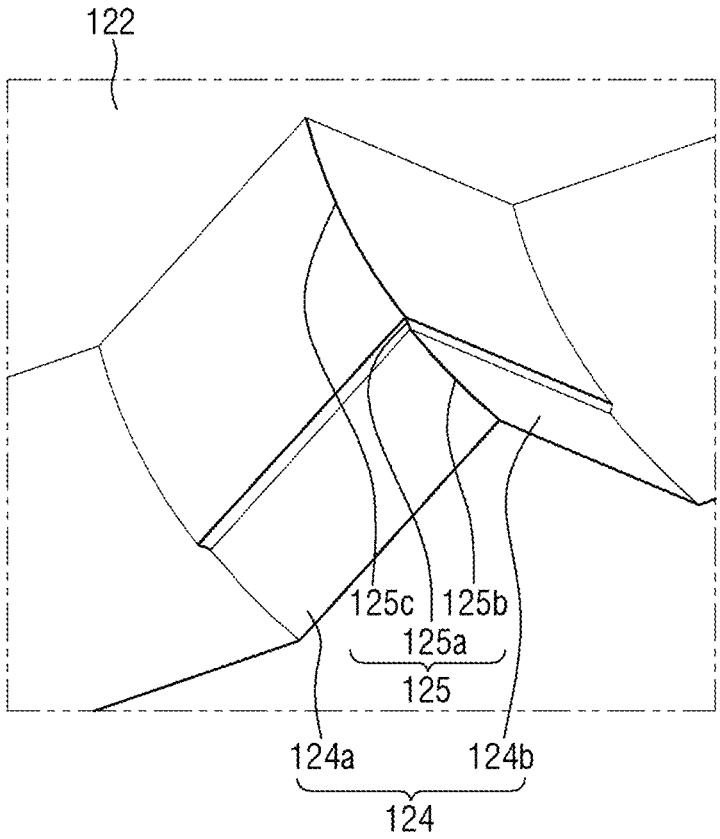
FIG. 8 is a partial perspective view of an edge portion according to an embodiment of the present disclosure.

The edge portion 125 may include an off-set or stepped portion 125*a*, a first edge 125*b*, and a second edge 125*c* as shown in FIG. 8. The stepped portion 125*a* may allow the inclined line CL1 to be formed in the low beam pattern. The first edge 125*b* may extend in the horizontal direction from the lower end of the stepped portion 125*a* to form the upper line CL2. The second edge 125*c* may extend in the horizontal direction from the upper end of the stepped portion 125*a* to form the lower line CL3.

Additionally, the present embodiment of the present disclosure illustrates a case where the stepped portion 125*a* is formed to extend from the edge portion 125 to the first surface 124*a* and the second surface 124*b* of the shield portion 124. The present disclosure is not limited thereto, and the stepped portion 125*a* may be formed only on the edge portion 125.

The position of the cut-off line, that is, the position of the inclined line CL1 may be varied depending on the position of the stepped portion 125*a*. The stepped portion 125*a* may be formed to be aligned with the optical axis AX2 of the light emitting portion 123 along the optical axis AX2. However, when a relatively wide beam pattern is formed, for example by adjusting the curvature of the light emitting portion 123, the cut-off line may be formed out of the intended position. For this reason, according to an embodiment of the present disclosure, the stepped portion 125*a* may be formed to be positioned off-set by a predetermined distance from the optical axis AX2 of the light emitting portion 123 and may thereby adjust the position where the upper line CL2 and the lower line CL3 are formed. Accordingly, the cut-off line may be formed at the correct position.

In other words, the cut-off line formed at the correct position may mean that the inclined line CL1 is disposed at the intersection of the H-H line and the V-V line as shown in FIG. 7. When the inclined line CL1 is formed out of position, either the upper line CL2 corresponding to the driving lane or the lower line CL3 corresponding to the opposite lane may be widened or narrowed, which may decrease the visibility of the driving lane or may cause glare to oncoming vehicles. By adjusting the position of the stepped portion 125*a* with respect to the optical axis AX2 of the light emitting portion 123 by a predetermined distance, the cut-off line may be formed at the right position.

Herein, the expression that the stepped portion 125*a* is formed to be aligned with the optical axis AX2 of the light emitting portion 123 may mean that a point in the stepped portion 125*a* is disposed on a plane that passes perpendicularly to the optical axis AX2 of the light emitting portion 123.

Figure 9:
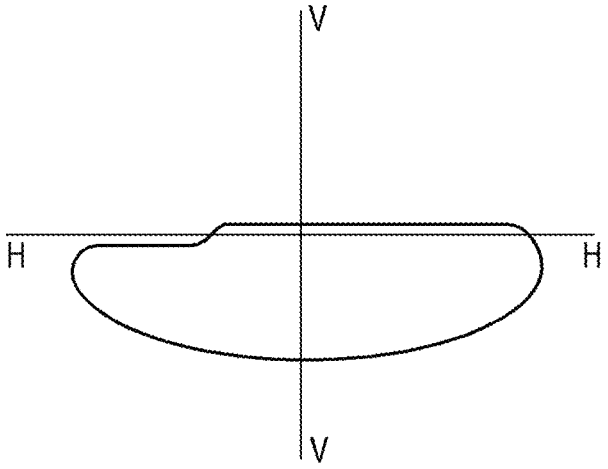
FIG. 9 compares cut-off lines formed due to different positions of a stepped portion.
Figure 9:
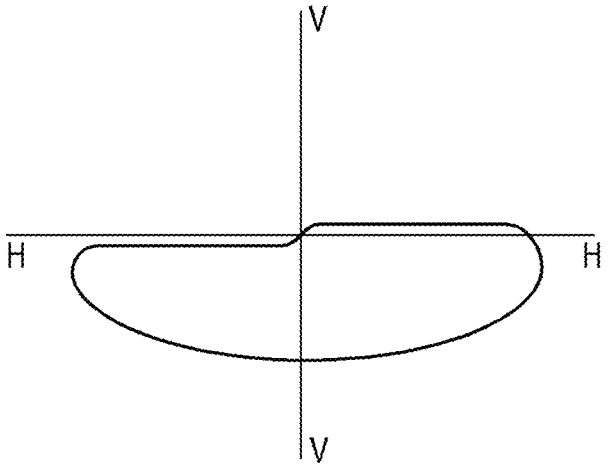

FIG. 9 is a schematic diagram comparing cut-off lines formed depending on the position of the stepped portion according to an embodiment of the present disclosure. FIG. 9 is an example of forming relatively wide beam patterns. Referring to FIG. 9, forming the stepped portion 125*a* to be aligned with the optical axis AX2 of the light emitting portion 123 may cause the cut-off line to be formed out of position. However, in the present disclosure, the position of the cut-off line may be adjusted by providing the stepped portion 125*a* to be spaced in one direction from the optical axis AX2 of the light emitting portion 123 by a predetermined distance.

The predetermined distance of the stepped portion 125*a* may vary depending on the width of the beam pattern. The greater the width of the beam pattern, the greater the predetermined distance, and vice versa. For example, when generating a spread region, the lamp module 100 of the present disclosure may form a wider beam pattern than a spot region. For this reason, the present disclosure may provide the lamp module 100 to appropriately form the spread region by adjusting the stepped portion 125*a* to be spaced farther from the optical axis AX2 of the light emitting portion 123.

Meanwhile, the lamp module 100 of the present disclosure may further include the lens unit 130 disposed in front of the light guide unit 120. The lens unit 130 may serve to satisfy the required light distribution characteristics of the beam pattern formed by the light emitted through the light emitting portion 123 while improving the exterior design of the lamp module 100.

The lens unit 130 of the present embodiment is illustrated as having a light incident surface 131 that is formed in a substantially planar shape, and a light emitting surface 132 including a plurality of optical elements 132*a* arranged in the vehicle's width direction. Each of the plurality of optical elements 132*a* may include a curved shape that is convex from side to side and protrudes toward the front of the vehicle. However, the present disclosure is not limited to such configuration. Depending on the light distribution characteristics of the beam pattern to be formed by the lamp module 100 of the present disclosure, the light incident surface 131 and the light emitting surfaces 132 of the lens unit 130 may have different variations in their shapes, orientations, curvatures, or the like.

Figure 10:
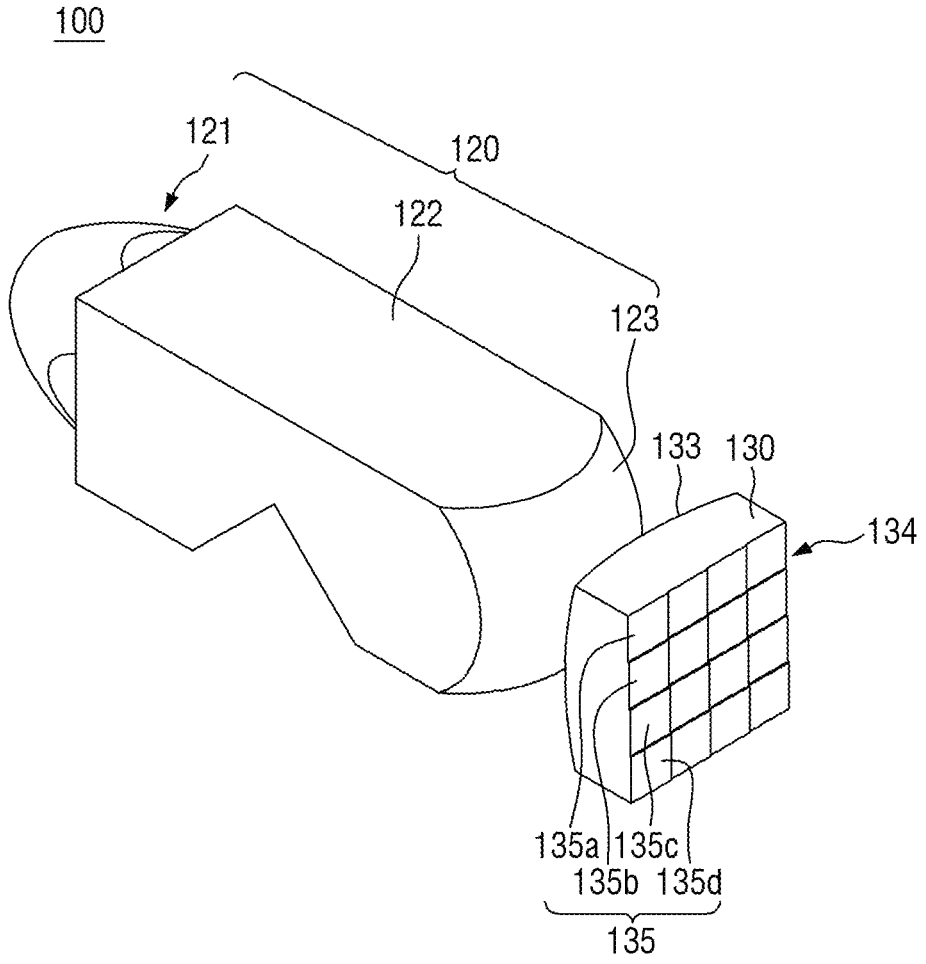
FIGS. 10 and 11 are perspective views of the lamp module according to another embodiment of the present disclosure.
Figure 11:
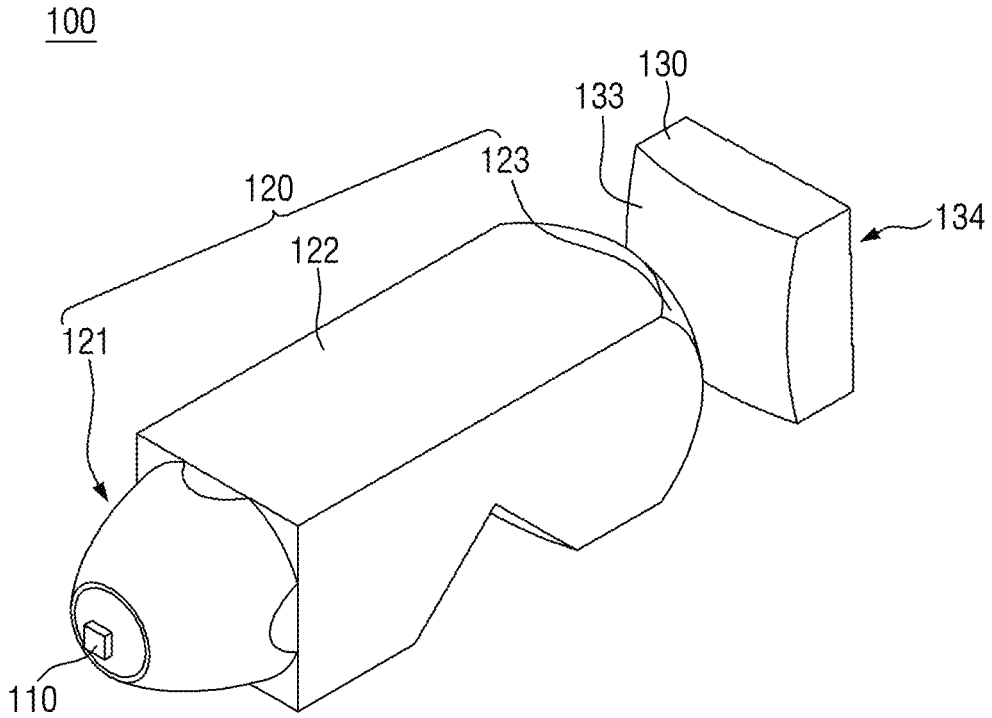
Figure 12:
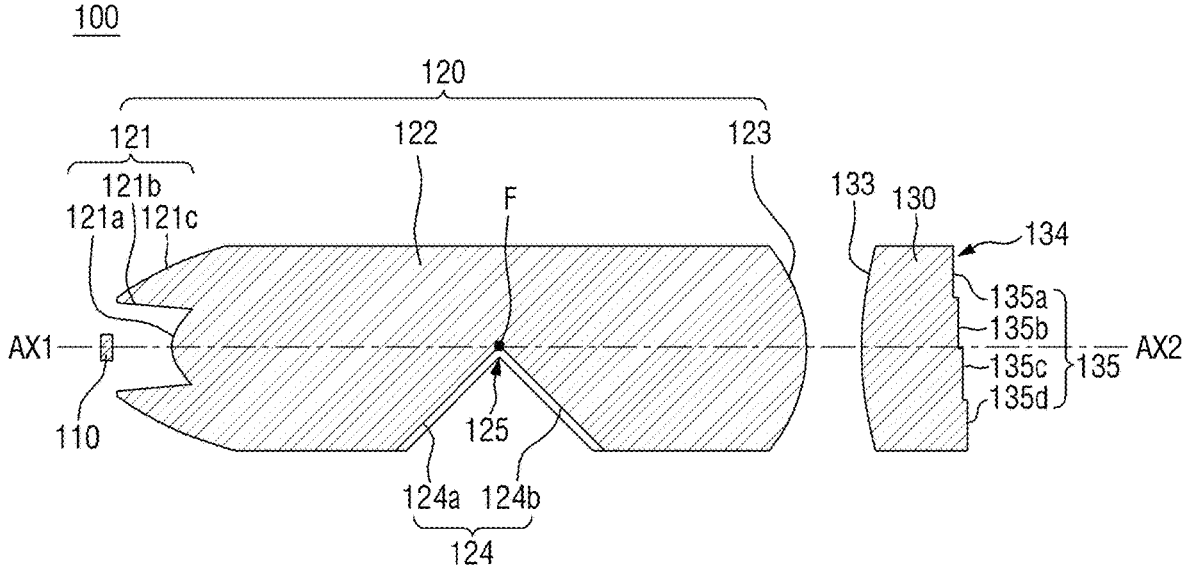
FIG. 12 is a cross-sectional view of the lamp module according to another embodiment of the present disclosure.

FIGS. 10 and 11 are perspective views of the lamp module 100 according to another embodiment of the present disclosure. FIG. 12 is a cross-sectional view showing the lamp module 100 according to another embodiment. Referring to FIGS. 10 to 12, the lamp module 100 according to another embodiment of the present disclosure may include s a light source unit 110, a light guide unit 120, and a lens unit 130 similar to those of the above-described embodiment. Here, the same reference numerals are used for components that serve similar functions as those of the above-described embodiment, and a detailed description thereof will be omitted.

In another embodiment of the present disclosure, the lens unit 130 may include a light incident surface 133 that is formed in a curved shape, which is convex toward the light emitting portion 123 of the light guide unit 120. The lens unit 130 may also include a light emitting surface 134 that includes at least one optical module 135. In turn, each of the at least one optical module 135 may include a plurality of optical elements 135*a*, 135*b*, 135*c*, and 135*d* that are disposed along the vertical direction and each having a substantially planar shape. Another embodiment of the present disclosure illustrates a case where a plurality of the optical modules 135 are arranged in the vehicle's width direction. Accordingly, in another embodiment of the present disclosure, the plurality of optical elements 135*a*, 135*b*, 135*c*, and 135*d* may be arranged in a grid shape across the light emitting surface 134.

In another embodiment of the present disclosure, the optical elements 135*a*, 135*b*, 135*c*, and 135*d* may include a stepped or terraced arrangement gradually advancing toward the lower side thereof. This configuration may prevent glare or the like from being generated by the light emitted through the lower optical element, among the optical elements adjacent to each other in the vertical direction, and being incident on the upper optical element.

Figure 13:
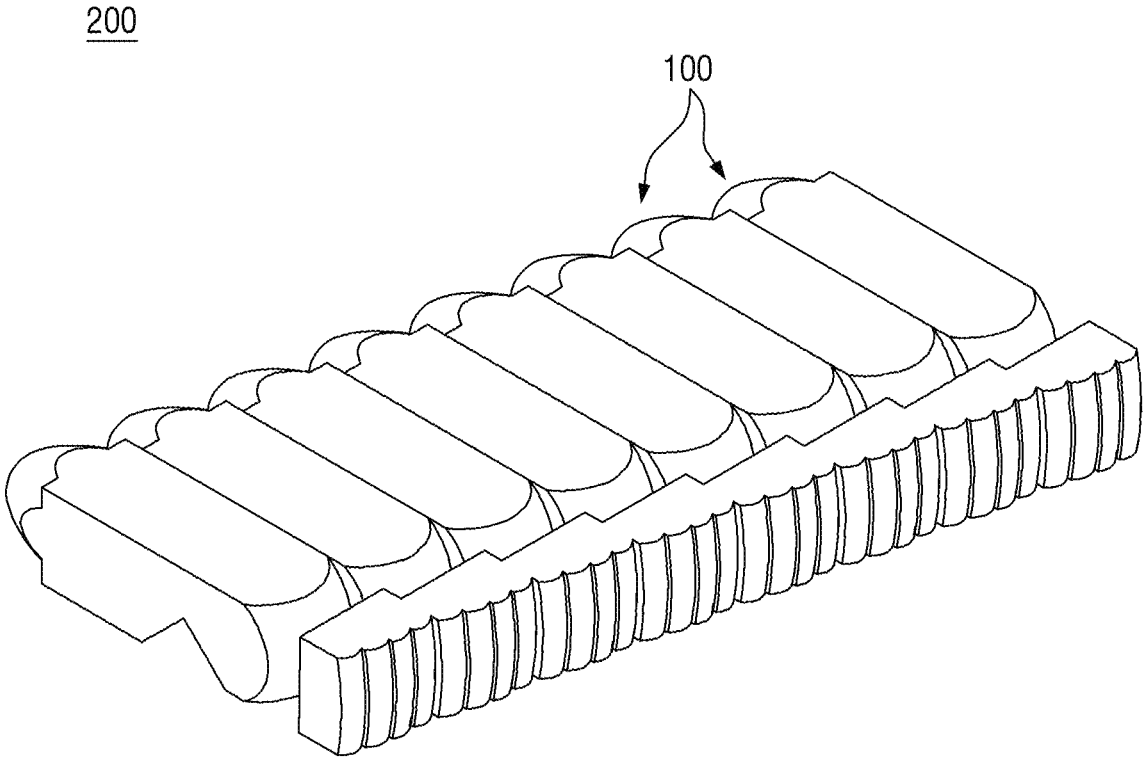
FIG. 13 is a perspective view of a vehicle lamp according to an embodiment of the present disclosure.
Figure 14:
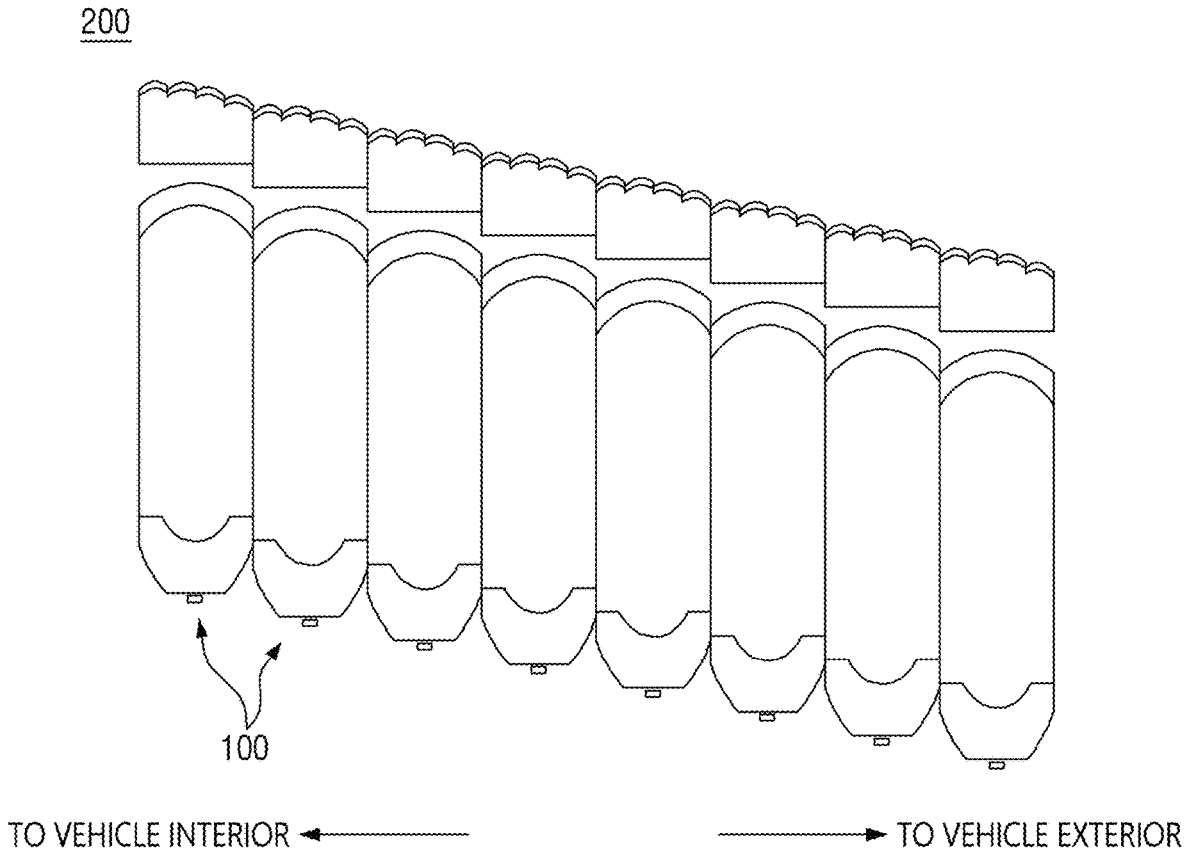
FIG. 14 is a plan view of the vehicle lamp according to an embodiment of the present disclosure.

FIG. 13 is a perspective view of a vehicle lamp 200 according to an embodiment of the present disclosure. FIG. 14 is a plan view of the vehicle lamp 200 according to an embodiment of the present disclosure. Referring to FIGS. 13 and 14, the vehicle lamp 200 according to an embodiment of the present disclosure may include a plurality of lamp modules 100 disposed in at least one direction. Each of the plurality of lamp modules 100 may be interpreted as performing the substantially same functions as those of the above-described lamp module 100.

FIGS. 13 and 14 show an illustrative case where the lamp modules 100 are disposed in the vehicle's width direction, but the present disclosure is not limited thereto. The plurality of multiple lamp modules 100 may be disposed in the vehicle's width (i.e., lateral) direction, vertical direction, or a combination thereof.

In an embodiment of the present disclosure, at least one of the plurality of lamp modules 100 may form a different region of the beam pattern from a region formed by at least one other of the lamp modules 100. For example, one of the plurality of lamp modules 100 may form a spot region of the beam pattern, and another one of the lamp modules 100 may form a spread region of the beam pattern.

In particular, to obtain a wider beam pattern in the spread region than in the spot region, curvatures of the light emitting portions 123 of the light guide units 120 may be adjusted to secure a sufficient width of the beam pattern. In such case, a first lamp module among the plurality of lamp modules 100 that is responsible for forming the spread region may be configured to have its stepped portion 125*a* disposed to be spaced apart from the optical axis AX2 of the light emitting portion 123 of the light guide unit 120.

On the other hand, among the plurality of lamp modules 100, a second lamp module that is responsible for forming the spot region may form a narrower beam pattern than the spread region, and therefore, the stepped portion 125*a* thereof may be disposed closer to the optical axis AX2 of the light emitting portion 123 than the first lamp module.

The vehicle lamp 200 of the present disclosure may be configured to arrange the plurality of lamp modules 100 to gradually recede from the inner side of the vehicle toward the outer side thereof, which would render the plurality of lamp modules 100 to be arranged conforming to the body contour of the vehicle. For example, in the vehicle lamp 200 of the present disclosure, the plurality of lamp modules 100 may be disposed in an internal space formed by a lamp housing and a cover lens coupled to the lamp housing. The plurality of lamp modules 100 may be disposed gradually advancing or gradually receding as they go from the inner side of the vehicle toward the outer side thereof so that the lamp modules 100 are in a conforming arrangement to the exterior contour of the cover lens that forms a portion of the body line of the vehicle.

Additionally, in the vehicle lamp 200 of the present disclosure, the plurality of optical elements 132*a* that constitute the light emitting surfaces 132 may be in a terraced arrangement gradually advancing or gradually receding from the inner side of the vehicle toward the outer side thereof as with the plurality of lamp modules 100, thereby improving the exterior design of the vehicle lamp 200 of the present disclosure.

FIGS. 13 and 14 described above are an example where the light emitting surface 132 of the lens unit 130 includes a plurality of optical elements 132*a* arranged in the vehicle's width direction as in FIG. 1 described above. However, the present disclosure is not limited thereto. The present disclosure may equally work well with the plurality of optical modules 135 respectively including a plurality of vertically arranged optical elements 135*a*, 135*b*, 135*c*, 135*d* and disposed in the vehicle's width direction, wherein the plurality of optical modules 135 may be in a terraced arrangement that gradually advances or gradually recedes going from the inner side of the vehicle toward the outer side thereof.

As described above, the vehicle lamp 200 of the present disclosure may allow the stepped portion 125*a* to be adjustably formed with a predetermined distance with respect to the optical axis AX2 of the light emitting portion 123 based on the width of the beam pattern to be formed by each of the plurality of lamp modules 100, thereby providing the cut-off line in the proper position. This configuration may enable a vehicle lamp to be implemented with a slimmer form factor while being able to provide an optimal beam formation.

While a few exemplary embodiments of the present disclosure have been described with reference to the accompanying drawings, those skilled in the art will readily appreciate that various changes in form and details may be made therein without departing from the technical idea and scope of the present disclosure as defined by the following claims. Therefore, it is to be understood that the foregoing is illustrative of the present disclosure in all respects and is not to be construed as limited to the specific exemplary embodiments disclosed.

In concluding the detailed description, those skilled in the art will appreciate that many variations and modifications can be made to the exemplary embodiments without substantially departing from the principles of the present disclosure. Therefore, the disclosed exemplary embodiments are used in a generic and descriptive sense only and not for purposes of limitation.

What is claimed is:

1. A lamp module, comprising:

a light source unit that generates light; and a light guide unit that emits at least a portion of the light incident from the light source unit to generate a beam pattern, wherein the light guide unit comprises:

a light incident portion configured to receive at least a portion of the light incident from the light source unit;

a light emitting portion configured to emit at least a portion of the light incident through the light incident portion; and a transmission portion disposed between the light incident portion and the light emitting portion and configured to transmit at least a portion of the light incident through the light incident portion to the light emitting portion, wherein the transmission portion comprises:

a shield portion including an edge portion formed along a rear focal plane of the light emitting portion and configured to obstruct a portion of the light that is incident through the light incident portion and directed to the light emitting portion, wherein the edge portion comprises:

a stepped portion;

a first edge that extends in a horizontal direction from a lower end of the stepped portion; and a second edge that extends in the horizontal direction from an upper end of the stepped portion, and wherein the stepped portion is disposed spaced apart by a predetermined distance from an optical axis of the light emitting portion.

2. The lamp module of claim 1, wherein the light incident portion comprises:

a central surface;

protruding surfaces formed to protrude from an outer peripheral end of the central surface toward the light source; and reflective surfaces for reflecting at least a portion of the light incident through the protruding surfaces toward the transmission portion disposed in front of the light incident portion.

3. The lamp module of claim 1, wherein the shield portion comprises a first surface and a second surface formed on a lower side of the transmission portion, wherein the first surface and the second surface are inclined in opposite directions along an optical axis direction of the light emitting portion, wherein the first surface has a first end and a second end, wherein the first end is closer to the light emitting portion and disposed above the second end, and the second surface has a first end disposed closer to the light emitting portion and a second end disposed above the first end, and wherein the edge portion is formed at a junction between the first end of the first surface and the second end of the second surface.

4. The lamp module of claim 1, wherein the predetermined distance is determined based on a width of the beam pattern to be formed by the lamp module.

5. The lamp module of claim 4, wherein the width of the beam pattern is determined by a curvature of the light emitting portion.

6. The lamp module of claim 4, wherein the predetermined distance increases as the width of the beam pattern increases.

7. The lamp module of claim 1, further comprising:

a lens unit that transmits at least a portion of the light emitted from the light guide unit, wherein the lens unit comprises a light incident surface for receiving at least a portion of the light incident from the light guide unit; and a light emitting surface configured to emit the light incident through the light incident surface, and wherein the light emitting surface comprises a plurality of optical elements arranged in at least one direction.

8. The lamp module of claim 7, wherein the light incident surface is convex rearwardly toward the light guide unit, and the optical elements are planar.

9. The lamp module of claim 7, wherein the light incident surface is planar, and the optical elements are convex forwardly.

10. A lamp for a vehicle, comprising a plurality of lamp modules arranged in at least one direction to generate a beam pattern, wherein each of the plurality of lamp modules comprises:

a light source unit that generates light; and a light guide unit that emits at least a portion of the light incident from the light source unit to generate the beam pattern, wherein the light guide unit comprises:

a light incident portion configured to receive at least a portion of the light incident from the light source unit;

a light emitting portion configured to emit at least a portion of the light incident through the light incident portion; and a transmission portion disposed between the light incident portion and the light emitting portion and configured to transmit at least a portion of the light incident through the light incident portion to the light emitting portion, and wherein the transmission portion comprises:

a shield portion including an edge portion formed along a rear focal plane of the light emitting portion and configured to obstruct a portion of the light that is incident through the light incident portion and directed to the light emitting portion, wherein the edge portion of each of the plurality of lamp modules comprises:

a stepped portion;

a first edge that extends in a horizontal direction from a lower end of the stepped portion; and a second edge that extends in the horizontal direction from an upper end of the stepped portion, and wherein the stepped portion of at least one of the plurality of lamp modules is disposed spaced apart by a predetermined distance from an optical axis of the light emitting portion.

11. The lamp for a vehicle of claim 10, wherein the predetermined distance varies from one of the plurality of lamp modules to another of the plurality of lamp modules.

12. The lamp for a vehicle of claim 10, wherein at least two of the plurality of lamp modules generate beam patterns with different widths, and wherein the predetermined distance varies depending on the widths of the beam patterns.

13. The lamp for a vehicle of claim 10, wherein the plurality of lamp modules are arranged gradually advancing or gradually receding from a first side to a second side in a vehicle's width direction.

14. The lamp for a vehicle of claim 10, wherein each of the plurality of lamp modules further comprises a lens unit that transmits at least a portion of the light emitted from the light guide unit, wherein the lens unit comprises a light incident surface for receiving at least a portion of the light incident from the light guide unit; and a light emitting surface comprising a plurality of optical elements arranged in at least one direction to emit the light incident through the light incident surface, and wherein the plurality of optical elements of each of the plurality of lamp modules are in a terraced arrangement gradually advancing or gradually receding from a first side to a second side in a vehicle's width direction.

* * * * *